US007762906B2

(12) United States Patent
Murphy et al.

(10) Patent No.: US 7,762,906 B2
(45) Date of Patent: Jul. 27, 2010

(54) GOLF CLUB HEAD WITH A LOW DENSITY BORE-THROUGH HOSEL

(75) Inventors: Stephen S. Murphy, Carlsbad, CA (US); Raymond L. Poynor, Oceanside, CA (US); Jeffrey W. Meyer, Fallbrook, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 10/872,368

(22) Filed: Jun. 22, 2004

(65) Prior Publication Data

US 2005/0282653 A1 Dec. 22, 2005

(51) Int. Cl.
*A63B 53/02* (2006.01)

(52) U.S. Cl. ..... 473/309; 473/345; 473/349

(58) Field of Classification Search ..... 473/345–346, 473/309–311, 349
See application file for complete search history.

(56) References Cited

U.S. PATENT DOCUMENTS

| | | | | | |
|---|---|---|---|---|---|
| 4,438,931 | A | | 3/1984 | Motomiya | 473/346 |
| 4,732,389 | A | * | 3/1988 | Kobayashi | 473/348 |
| 4,762,322 | A | * | 8/1988 | Molitor et al. | 473/345 |
| 4,854,582 | A | | 8/1989 | Yamada | 473/309 |
| 4,948,132 | A | | 8/1990 | Wharton | 473/246 |
| 5,042,806 | A | | 8/1991 | Helmstetter | 473/311 |
| 5,067,715 | A | | 11/1991 | Schmidt et al. | 473/332 |
| 5,163,682 | A | | 11/1992 | Schmidt et al. | 473/332 |
| 5,310,186 | A | * | 5/1994 | Karsten | 473/345 |
| 5,318,300 | A | | 6/1994 | Schmidt et al. | 473/305 |
| 5,538,246 | A | | 7/1996 | Dekura | 473/311 |
| 5,575,723 | A | * | 11/1996 | Take et al. | 473/305 |
| 5,766,089 | A | | 6/1998 | Dekura | 473/305 |
| 5,772,526 | A | * | 6/1998 | Hano | 473/314 |
| 5,839,973 | A | | 11/1998 | Jackson | 473/305 |
| 5,851,155 | A | | 12/1998 | Wood et al. | 473/246 |
| 5,851,160 | A | * | 12/1998 | Rugge et al. | 473/349 |
| 5,855,526 | A | | 1/1999 | Honma | 473/310 |
| 5,906,549 | A | | 5/1999 | Kubica | 473/314 |
| 5,935,020 | A | * | 8/1999 | Stites et al. | 473/345 |
| 5,967,904 | A | * | 10/1999 | Nagai et al. | 473/345 |
| 6,106,412 | A | | 8/2000 | Kosugi et al. | 473/305 |
| 6,251,028 | B1 | | 6/2001 | Jackson | 473/305 |
| 6,344,002 | B1 | * | 2/2002 | Kajita | 473/330 |
| 6,435,978 | B1 | | 8/2002 | Galloway et al. | 473/305 |
| 6,454,664 | B1 | * | 9/2002 | Long et al. | 473/330 |

(Continued)

FOREIGN PATENT DOCUMENTS

JP 2000-210398 A * 8/2000

(Continued)

*Primary Examiner*—Stephen L. Blau
(74) *Attorney, Agent, or Firm*—Hanify & King, P.C.

(57) ABSTRACT

A golf club including a head, a bore-through hosel insert, and a shaft is disclosed and claimed. The head includes a passage in which the bore-through hosel insert is positioned and retained. The bore-through hosel insert has a specific gravity much lower than the club head specific gravity. This allows mass that would necessarily have been located in the hosel in the heel of the club head to be relocated to more beneficial areas of the club. This allows the club designer to, for example, increase the overall size of the club head, expand the sweet spot, enhance the moment of inertia, and/or optimize the club head center of gravity location.

28 Claims, 2 Drawing Sheets

U.S. PATENT DOCUMENTS

| | | | | |
|---|---|---|---|---|
| 6,475,100 | B1 * | 11/2002 | Helmstetter et al. | 473/309 |
| 6,524,194 | B2 | 2/2003 | McCabe | 473/305 |
| 6,582,323 | B2 * | 6/2003 | Soracco et al. | 473/342 |
| 6,676,535 | B2 * | 1/2004 | Sheets et al. | 473/328 |
| 6,769,994 | B2 * | 8/2004 | Boone | 473/245 |
| 6,776,726 | B2 * | 8/2004 | Sano | 473/330 |
| 6,860,823 | B2 * | 3/2005 | Lee | 473/329 |
| 7,059,972 | B2 * | 6/2006 | Miyamoto | 473/330 |
| 2003/0032500 | A1 * | 2/2003 | Nakahara et al. | 473/345 |
| 2004/0132544 | A1 * | 7/2004 | Doi | 473/345 |
| 2004/0157678 | A1 * | 8/2004 | Kohno | 473/314 |
| 2004/0192461 | A1 * | 9/2004 | Chen | 473/311 |

FOREIGN PATENT DOCUMENTS

| | | | |
|---|---|---|---|
| JP | 2001017585 | A * | 1/2001 |
| JP | 2004041418 | A * | 2/2004 |

* cited by examiner

GOLF CLUB HEAD WITH A LOW DENSITY BORE-THROUGH HOSEL

BACKGROUND OF THE INVENTION

1. Field of the Invention

The present invention relates to a golf club, and, more particularly, the present invention relates to a golf club with improved center of gravity locations and moment of inertia values.

2. Description of the Related Art

It is known to make wood-type golf clubs out of metallic materials. These clubs were originally manufactured primarily by casting durable metals such as stainless steel, aluminum, beryllium copper, etc. into a unitary structure comprising a metal body, face, and hosel. As technology progressed, it became more desirable to strengthen the face of the club, usually by using a titanium material.

With a high percentage of amateur golfers constantly searching for more distance on their drives, the golf industry has responded by providing golf clubs specifically designed with distance in mind. The head sizes have increased, allowing the club to possess a higher moment of inertia, which translates to a greater ability to resist twisting on off-center hits. However, as a wood head becomes larger, its center of gravity will be moved back away from the face resulting in hits flying higher than expected. Also with the larger heads, the center of gravity is moved further away from the hosel axis. This can cause these large head clubs to remain open on contact, thereby inducing a "slice" effect (in the case of a right-handed golfer, the ball deviates to the right).

While increasing the club head size to provide the average golfer with more distance is important, it is also important to keep the club head weight constant or to reduce the club head weight. This has been achieved by casting consistently thinner shell thickness and going to lighter materials such as titanium.

SUMMARY OF THE INVENTION

The golf club of the present invention includes a head, a bore-through hosel insert, and a shaft. The head includes a passage in which the bore-through hosel insert is positioned and retained. The shaft extends through the club head from the crown to the sole. The bore-through hosel insert may extend to the club head sole, or it may abut a step within the club head passage.

The bore-through hosel insert has a specific gravity much lower than the club head specific gravity. This allows mass that would necessarily have been located in the hosel in the heel of the club head to be relocated to more beneficial areas of the club. This allows the club designer to, for example, increase the overall size of the club head, expand the sweet spot, enhance the moment of inertia, and/or optimize the club head center of gravity location. To further reduce mass in the hosel area of the heel, the club head passage in which the bore-through hosel insert is retained may be provided in two noncontiguous portions, one adjacent the crown and one adjacent the sole.

The club head may be provided with a receptacle located, for example, in the sole. A sole insert may be positioned and retained within the receptacle. The sole insert may take any desired form, such as a weight member or a vibration damper.

DESCRIPTION OF THE DRAWINGS

The present invention is described with reference to the accompanying drawings, in which like reference characters reference like elements, and wherein.

DETAILED DESCRIPTION OF THE INVENTION

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

Figure 1:
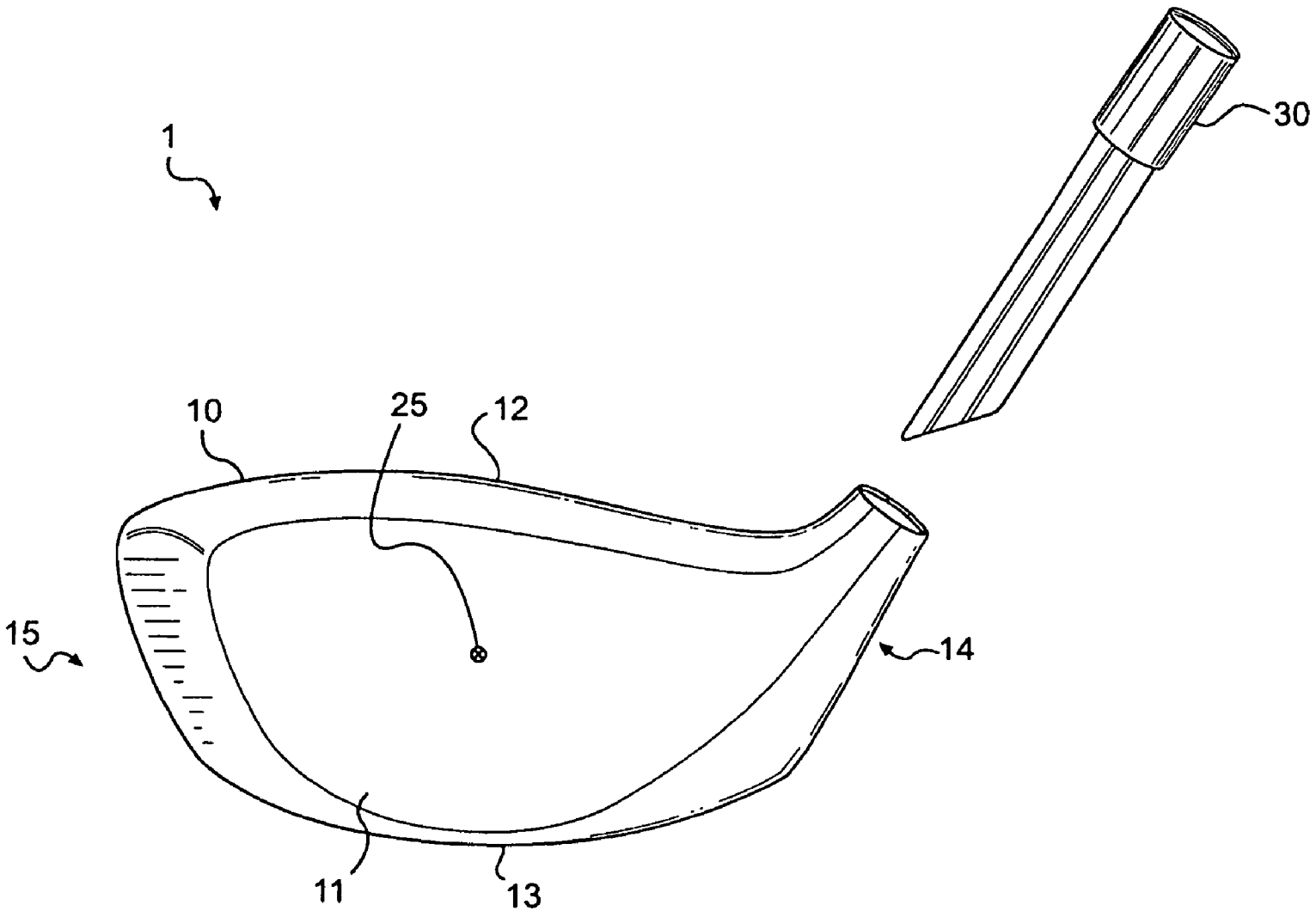
FIG. 1 shows a golf club of the present invention.
Figure 2:
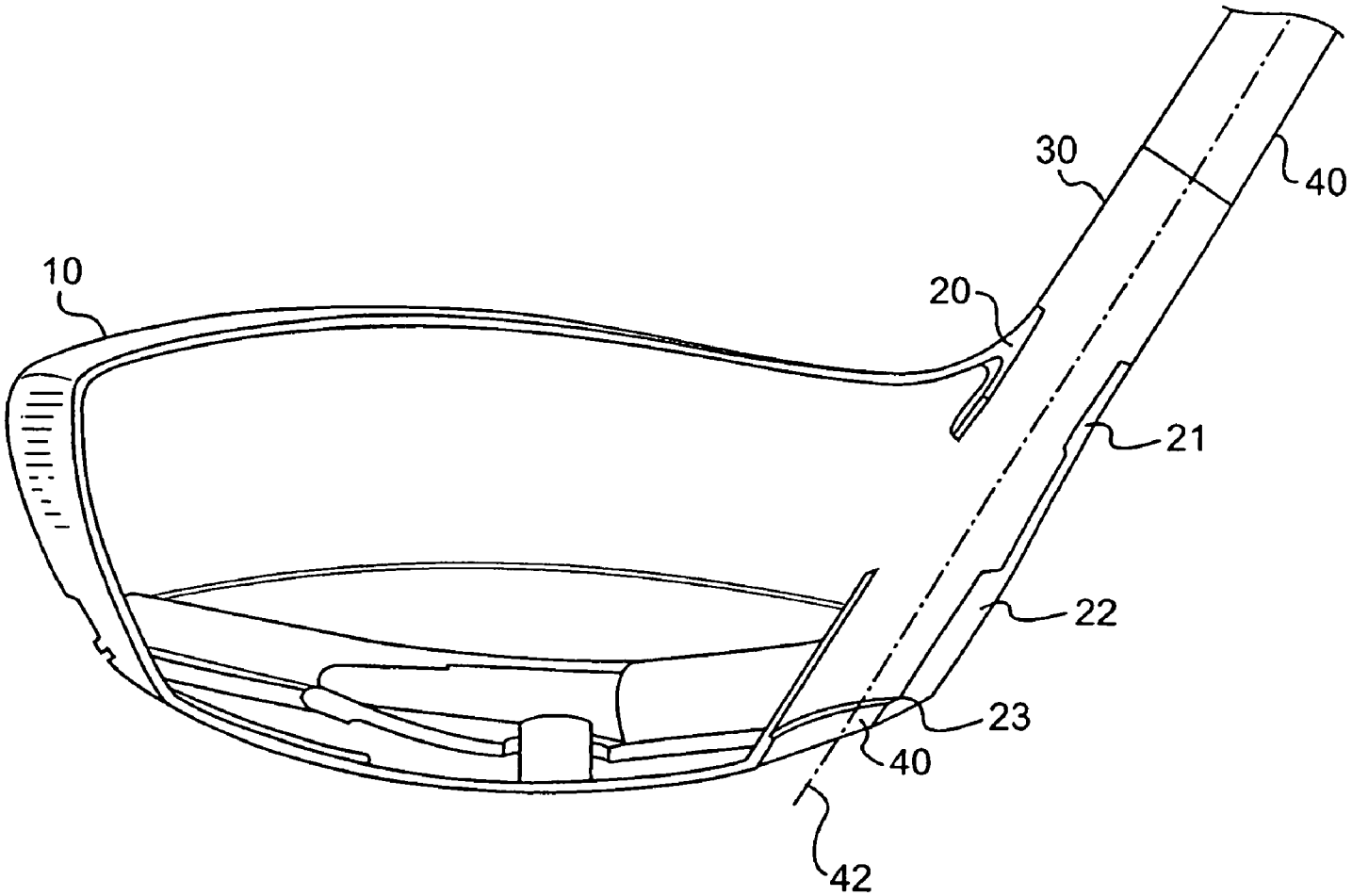
FIG. 2 shows a cut-away front view of the golf club of FIG. 1.

FIG. 1 shows a golf club 1 of the present invention, and FIG. 2 shows a cut-away front view of the golf club 1. The club 1 includes a head 10 having a strike face 11, a crown 12, a sole 13, a heel 14, and a toe 15. The head 1 further has a passage 20 therethrough from the crown 12 to the sole 13 in a proximity of the heel 14. The strike face 11 and/or the sole 13 may be integral with the head 10, or may be separate bodies, such as inserts, joined thereto. The club head 10 further includes a passage 20 therethrough from the crown 12 to the sole 13 in a proximity of the heel 14. The club head 10 preferably defines a volume greater than 100 cubic centimeters, and the club head 10 preferably is a wood-type golf club head.

The golf club 1 also comprises a bore-through hosel insert 30. The bore-through hosel insert 30 is positioned within the passage 20 and retained therein in known fashion, such as by an adhesive. A shaft 40 is positioned and retained within the bore-through hosel insert 30. The shaft 40 extends to the sole 13, and is trimmed to match the contours of the sole 13. The bore-through hosel insert 30 may extend to the sole 13 and be trimmed to match its contours, or the passage 20 can be provided with a step 23 that the bore-through hosel insert 30 abuts. Preferably, the step 23 is near but not abutting the sole 13.

The club head moment of inertia (MOI) is an important factor in the playability of the golf club. Inertia is a property of matter by which a body remains at rest or in uniform motion unless acted upon by some external force. MOI is a measure of the resistance of a body to angular acceleration about a given axis, and is equal to the sum of the products of each element of mass in the body and the square of the element's distance from the axis. Thus, as the distance from the axis increases, the MOI increases.

MOI is an important quality of a golf club because if the ball striking location is not precisely in line with the club head center of gravity, the impact will cause a twisting moment in the club head. If the club head twists during impact, the resulting golf shot will likely veer off the intended course. First, the twisting force will alter the initial trajectory of the golf shot. Second, club head twisting at impact will induce a rotation opposite the club head rotation. This is known as "gear effect." This rotation will further adversely affect the ball flight.

The larger a club head's MOI, the more resistance the club head has to this shot-altering twisting. In other words, the larger a club head's MOI, the more forgiving and playable the golf club is. With a large MOI, a golf club will still produce a straight ball flight for shots that are not struck precisely in line with the club head center of gravity. Important axes for which to have large MOI include the vertical and horizontal axes passing through the club head center of gravity, and the longitudinal axis of the shaft.

The strike face 11 has a geographic center 25. The club head 10, with the bore-through hosel insert 30 positioned within the passage 20, has a center of gravity that, preferably, is located less than 0.11 inch from the geographic center 25. Having the center of gravity aligned with the geographic center 25 maximizes the club sweet spot (the region of desired impact locations on the strike face 11). Here, "aligned" means collinear with a line substantially perpendicular to the strike face 11 and passing through the center of gravity. The center of gravity may be biased towards the heel 14, making it easier to close the club head 10 during the golf swing. Similarly, the center of gravity may be biased towards the sole 13, making it easier to get the golf ball airborne. The center of gravity preferably is located approximately 1 inch from an outer surface of the sole. Moving the center of gravity back away from the strike face 11 also facilitates getting the golf ball airborne.

The shaft 40 has a longitudinal axis 42. The head 10, with the bore-through hosel insert 30 positioned within the passage 20, preferably has a center of gravity located more than 1.3 inches from the axis 42. Other preferred ranges include from 1.2 inches to 1.5 inches from the axis 42, and from 1.3 inches to 1.4 inches from the axis 42. The center of gravity preferably is located from 0.5 inch to 1 inch behind the axis 42, and more preferably from 0.6 inch to 0.7 inch behind the axis 42.

The head 10, to maintain stability of the club during the golf swing, preferably has a center of gravity 25 and a MOI about a vertical axis passing through the center of gravity 25.

To better control the club head center of gravity and MOI, the bore-through hosel insert 30 of the present invention has a low mass. This allows the mass that would have been placed in the hosel to be relocated to other areas of the club 1 in order to, for example, increase the overall size of the club head 10, expand the sweet spot, enhance the MOI, and/or optimize the club head center of gravity location. The specific gravity of the bore-through hosel insert 30 preferably is less than three, and more preferably is less than two. The head 10 preferably has a specific gravity more than one point greater than the bore-through hosel insert specific gravity, and it may be greater than four (in absolute terms). Preferred materials for the bore-through hosel insert 30 include magnesium, which has a specific gravity of approximately 1.75. A preferred material for the club head 10 includes titanium, which has a specific gravity of approximately 4.51.

As an additional means of reducing the amount of mass in the heel 14 of the club head 10, the passage 20 may be provided in two noncontiguous portions. The passage 20 may comprise a first portion 21 adjacent the crown 12 and a second portion 22 adjacent the sole 13. Removal of the central portion between the crown and sole portions 21, 22 provides further mass that can be relocated to more beneficial locations on the golf club 1.

To counteract the torque that necessarily is created during a golf swing, at least a portion of the passage 20 has an indexed cross-section. For example, at least a portion of the passage 20 has a non-circular cross-section. The bore-through hosel insert 30 contains a corresponding indexed cross-section. These indexed cross-sections allow the bore-through hosel insert 30 to be placed within the passage 20 in only one orientation. That is, the bore-through hosel insert 30 is keyed-in. Thus, the torque forces generated during a golf swing are not transmitted to the shaft 40, the connection means between the shaft 40 and the bore-through hosel insert 30, or the connection means between the bore-through hosel insert 30 and the passage 20.

While the preferred embodiments of the present invention have been described above, it should be understood that they have been presented by way of example only, and not of limitation. It will be apparent to persons skilled in the relevant art that various changes in form and detail can be made therein without departing from the spirit and scope of the invention. Thus the present invention should not be limited by the above-described exemplary embodiments, but should be defined only in accordance with the following claims and their equivalents.

What is claimed is:

1. A golf club, comprising:

a head having a strike face, a crown, a sole, a heel, and a toe, said head having a passage therethrough from said crown to said sole in a proximity of said heel, said head including titanium, wherein the strike face has a geographic center;

a bore-through hosel insert positioned within said passage, said hosel insert abutting an interior heel wall of said head; and a shaft positioned within said bore-through hosel insert and extending to said sole; wherein:

said bore-through hosel insert has a first specific gravity less than 2.5 and containing magnesium;

said passage includes a step near but not abutting said sole;

said bore-through hosel insert abuts said step;

said shaft has a longitudinal axis; and said head, with said bore-through hosel insert positioned within said passage, has a center of gravity located more than 1.3 inches from said axis and aligned less than 0.11 inch from the geographic center of the strike face; and wherein said center of gravity is located approximately 1 inch from an outer surface of said sole.

2. The golf club of claim 1, wherein said first specific gravity is less than 2.

3. The golf club of claim 1, wherein said head has a second specific gravity more than one point greater than said first specific gravity.

4. The golf club of claim 3, wherein said second specific gravity is greater than 4.

5. The golf club of claim 1, wherein said passage includes a first portion adjacent said crown and a second portion adjacent said sole, said first and second portions being noncontiguous.

6. The golf club of claim 1, wherein said passage contains a portion having a first indexed cross-section, and said bore-through hosel insert contains a portion having a second indexed cross-section corresponding to said first indexed cross-section.

7. The golf club of claim 1, wherein said center of gravity is located on a heel side of said geographic center.

8. The golf club of claim 1, wherein said center of gravity is located on a sole side of said geographic center.

9. The golf club of claim 1, wherein said head, with said bore-through hosel insert positioned within said passage, has a center of gravity located from 1.2 inches to 1.5 inches from said axis.

10. The golf club of claim 9, wherein said center of gravity is located from 1.3 inches to 1.4 inches from said axis.

11. The golf club of claim 1, wherein said head, with said bore-through hosel insert positioned within said passage, has a center of gravity located from 0.5 inch to 1 inch behind said axis.

12. The golf club of claim 11, wherein said center of gravity is located from 0.6 inch to 0.7 inch behind said axis.

13. The golf club of claim 1, wherein said head defines a volume greater than 100 cubic centimeters.

14. The golf club of claim 1, wherein the golf club is a wood-type golf club.

15. The golf club of claim 1, wherein said head and said bore-through hosel insert are formed of different materials.

16. The golf club of claim 1, wherein said insert extends from said crown to a position adjacent said sole.

17. The golf club of claim 1, wherein said step is adjacent said sole.

18. A golf club, comprising:

a head having a strike face, a crown, a sole, a heel, and a toe, said head comprising a passage therethrough from said crown to said sole in a proximity of said heel, wherein the strike face has a geographic center;

a keyed-in, magnesium bore-through hosel insert positioned within said passage, said hosel insert abutting an interior heel wall of said head; and a shaft positioned with said bore-through hosel and extending to said sole, wherein the head comprises a center of gravity that is aligned less than 0.11 inch from the geographic center of the strike face when the bore-through hosel insert is in position; and wherein said center of gravity is located approximately 1 inch from an outer surface of said sole.

19. The golf club of claim 18, wherein:

said passage includes a step near but not abutting said sole; and said bore-through hosel insert abuts said step.

20. The golf club of claim 19, wherein said step is adjacent said sole.

21. The golf club of claim 18, wherein said head includes titanium.

22. The golf club of claim 18, wherein said insert extends from said crown to a position adjacent said sole.

23. A golf club, comprising:

a titanium head body having a strike face, a crown, a sole, a heel, and a toe, said head having a passage therethrough from said crown to said sole in a proximity of said heel, wherein the strike face has a geographic center;

a magnesium bore-through hosel insert positioned within said passage, said hosel insert abutting an interior heel wall of said head; and a shaft positioned with in said bore-through hosel insert and extending to said sole; wherein:

said head body has a first specific gravity, said bore-through hosel insert has a second specific gravity more than one point less than said first specific gravity, wherein the second specific gravity is less than 2;

said passage includes a step near but not abutting said sole;

said bore-through hosel insert abuts said step;

said head comprises a center of gravity that is aligned less than 0.11 inch from the geographic center of the strike face when the bore-through hosel insert is in position; and wherein said center of gravity is located approximately 1 inch from an outer surface of said sole.

24. The golf club of claim 23, wherein said passage includes a first portion adjacent said crown and a second portion adjacent said sole, said first and second portions being noncontiguous.

25. The golf club of claim 23, wherein:

said shaft has a longitudinal axis; and said head, with said bore-through hosel insert positioned within said passage, has a center of gravity located more than 1.3 inches from said axis.

26. The golf club of claim 24, wherein said center of gravity is located from 0.5 to 1 inch behind said axis.

27. The golf club of claim 23, wherein said bore-through hosel insert is keyed-in to said passage.

28. The golf club of claim 27, wherein said passage contains a portion having a first indexed cross-section, and said bore-through hosel insert contains a portion having a second indexed cross-section corresponding to said first indexed cross-section.

* * * * *